US006003251A

United States Patent [19]

Walsh et al.

[11] Patent Number: 6,003,251

[45] Date of Patent: Dec. 21, 1999

[54] DEBRIS SEPARATOR FOR DREDGE OR SLURRY PUMP

[75] Inventors: Michael R. Walsh, Weathersfield, Vt.; Sig Jokiel, Anchorage, Ak.

[73] Assignee: The United States of America as represented by the Secretary of the Army, Washington, D.C.

[21] Appl. No.: 09/121,122

[22] Filed: Jul. 23, 1998

[51] Int. Cl.[6] ..... E02F 3/88

[52] U.S. Cl. ..... 37/320; 210/112; 210/170

[58] Field of Search ..... 37/320, 317, 318, 37/319, 345, 905; 210/170, 154, 112, 109; 299/9, 8, 1

[56] References Cited

U.S. PATENT DOCUMENTS

| | | | |
|---|---|---|---|
| 675,123 | 5/1901 | Bartholomew | 37/314 |
| 996,237 | 6/1911 | Gridley | 37/318 |
| 1,169,745 | 1/1916 | Haddon | 37/318 X |
| 2,250,693 | 7/1941 | York et al. | 37/318 X |
| 3,731,975 | 5/1973 | Lindelof | 299/8 |
| 4,250,034 | 2/1981 | Wolters | 210/170 |
| 4,319,782 | 3/1982 | Latimer | 299/1 |
| 4,347,675 | 9/1982 | Latimer | 37/57 |
| 4,541,927 | 9/1985 | Breidenbaugh | 210/170 X |
| 4,744,896 | 5/1988 | James et al. | 210/170 |
| 5,141,650 | 8/1992 | Cavo et al. | 210/112 X |
| 5,425,188 | 6/1995 | Rinker | 37/317 |
| 5,651,200 | 7/1997 | Walsh et al. | 37/329 |

*Primary Examiner*—Victor Batson
*Attorney, Agent, or Firm*—Luther A. Marsh

[57] ABSTRACT

A debris separator for a dredge pump includes a body portion having a top wall, a bottom wall, first and second side walls, and an aft end wall, the aft end wall defining a separator outlet for connection to the pump, a funnel portion having an entry end defining a separator inlet and a larger discharge end fixed to a forward inlet end of the body portion. The separator further includes a door hingedly mounted on the body portion first side wall and spring biased to a closed position overlying an opening in the first side wall, and a floor in the body portion slanted toward the bottom wall and toward the first side wall opening. Thus, upon stopping of the pump, back pressure is generated in the body by backflow of water into the separator. Backpressure causes the hinged side door to open. Heavy objects which have fallen to the slanted floor, due to the reduction of flow velocity through the separator, are flushed out of the separator with discharge water. When the discharge line empties, or the pump is restarted, the door closes under the spring bias.

7 Claims, 3 Drawing Sheets

DEBRIS SEPARATOR FOR DREDGE OR SLURRY PUMP

BACKGROUND OF THE INVENTION (1) Field of the Invention

This invention relates to separator devices and more particularly to a separator device of the type adapted to intercept and discard heavy objects drawn into an intake in communication with a dredge pump, slurry pump, or the like.

(2) Description of the Prior Art

In dredging operations, wherein water and silt, as from a water body bed, are ingested by a body connected to a rotary pump, and passed through the body and through the pump toward a dump location, an ever-present hazard is the occasional relatively large heavy object, particularly unexploded ordnance, ingested into the system. If the object reaches the pump, the pump may be extensively damaged and if the object is explosive, obviously a threat to life can be activated.

Accordingly, there is a need for a separator between the water inlet and the pump inlet for automatically separating out such objects and discharging such objects from the water flow stream prior to the entry of the object into the pump inlet.

SUMMARY OF THE INVENTION

An object of the invention is to provide a debris separator for dredge or slurry pump operations, which separator is adapted to separate relatively large heavy objects from the water flow through the separator and to discharge the object before the object reaches the pump inlet.

With the above and other objects in view, as will hereinafter appear, a feature of the present invention is the provision of a debris separator for a dredge pump, or the like. The separator comprises a body portion having a top wall, a bottom wall, first and second side walls, and an aft end wall, the aft end wall defining a separator outlet for connection to the pump, a funnel portion having an entry end defining a separator inlet and a larger discharge end fixed to a forward inlet end of the body portion. A door is hingedly mounted on the body portion first side wall and is spring biased to a closed position overlying an opening in the first side wall. A floor in the body portion is slanted toward the bottom wall and toward the first side wall opening. Thus, a heavy object taken into the funnel portion is carried by water taken therein to the body portion and drops to the floor and moves down the slanted floor to the door. Upon stopping of the pump, the water pressure in the body portion forces the door open against the spring bias and the object exits the separator. Upon exiting of the object, the door closes under the spring bias.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent.

In the drawings.

DESCRIPTION OF THE PREFERRED EMBODIMENT

Figure 1:
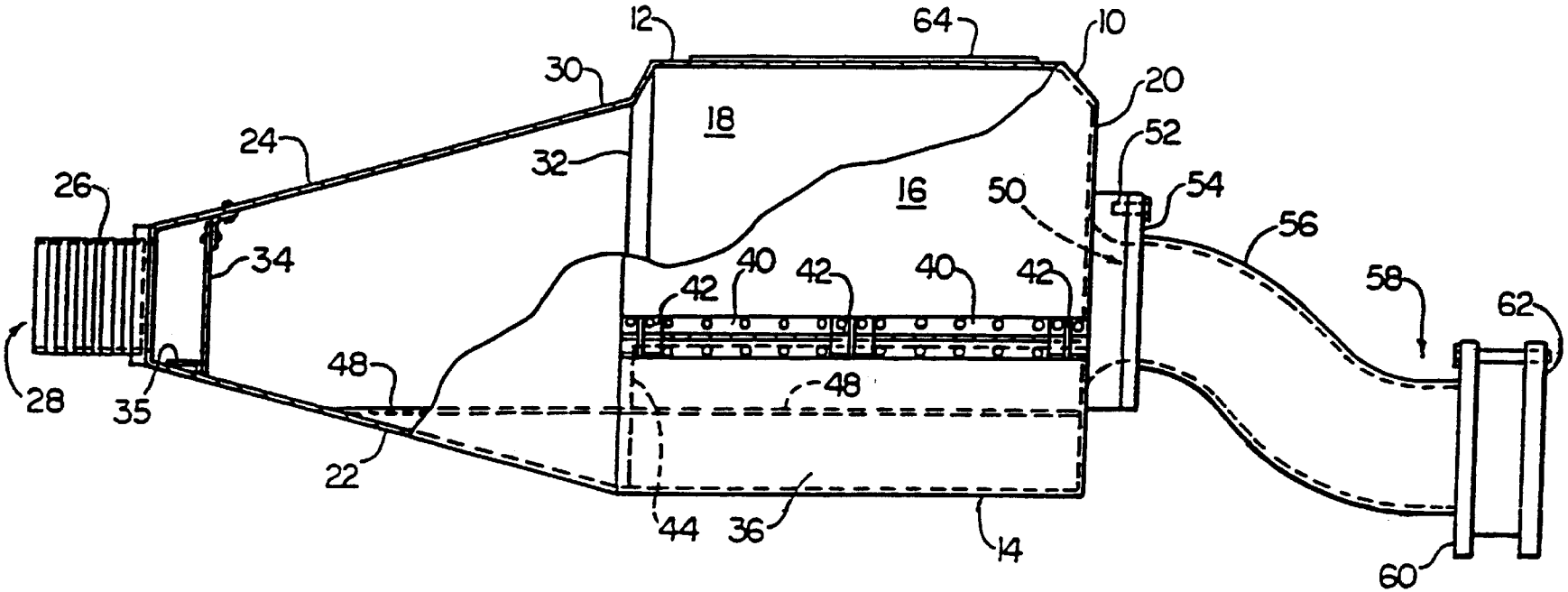
FIG. 1 is a side elevational, partly broken away, view of one form of separator illustrative of an embodiment of the invention.
Figure 2:
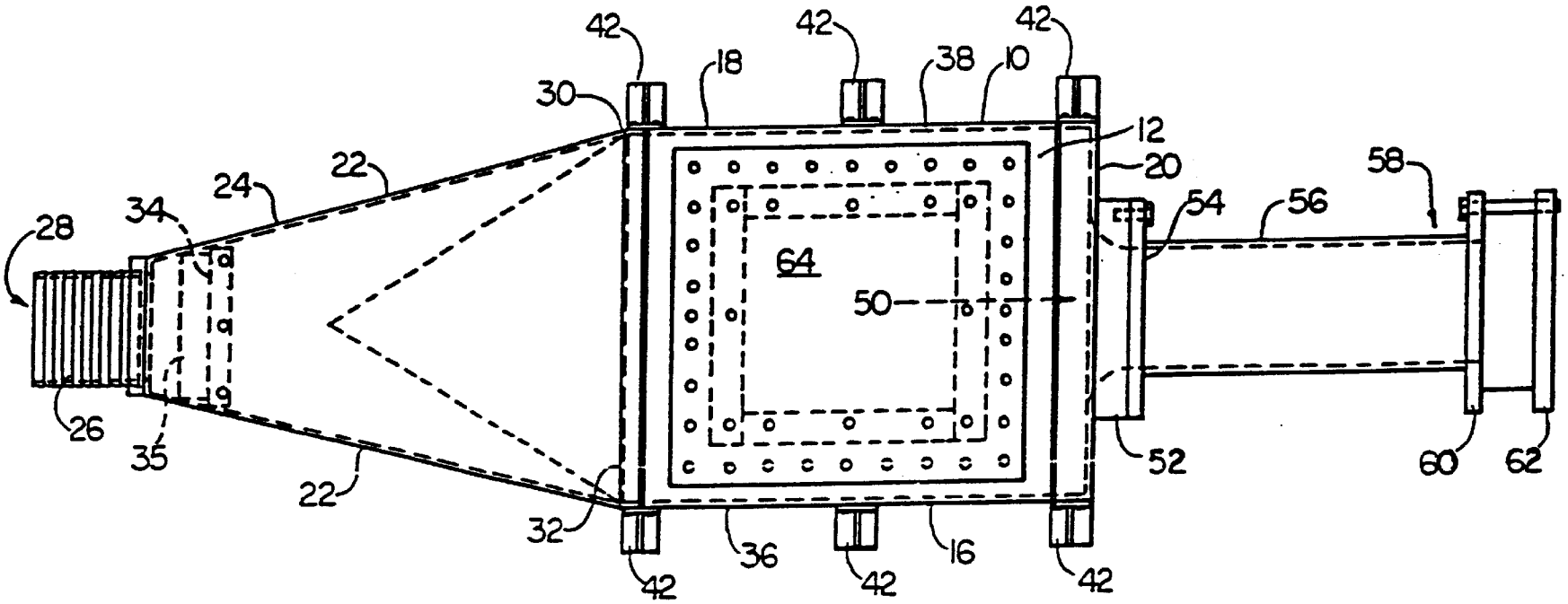
FIG. 2 is a top plan view of the separator of FIG. 1.

Referring to FIG. 1, it will be seen that an illustrative embodiment of the debris separator includes a body portion 10 having a top wall 12, a bottom wall 14, first and second side walls 16, 18 and an aft end wall 20.

A funnel portion 24 is provided with an entry end 26, defining a separator inlet 28. A larger discharge end 30 of the funnel portion 24 is fixed to, and preferably integral with, a forward inlet end 32 of the body portion 10. The funnel portion 24 is provided with side walls 22 which are angled outwardly and rearwardly in such a manner as to prevent separation of flow from the walls, thereby insuring maximum reduction of water flow velocity through the funnel portion 24, without the occurrence of turbulent eddies.

A door 34 is hingedly hung in the funnel portion 24 and operative to pivot rearwardly (rightwardly as viewed in FIG. 1) to permit inflow of water, silt, and the like. However, the door 34 cannot swing forwardly and therefore serves as a one-way valve, permitting flow through the funnel portion 24 only in a front-to-rearward direction. A stop 35 prevents the door 34 from lodging closed.

The body portion 10 is provided with a hinged door 36, 38 on at least one, and preferably both, of the body portion side walls 16, 18 (FIG. 3) The door 36 is fixed to hinges 40 mounted on the side wall 16. Similarly, the door 38 is fixed to hinges 40 mounted on the side wall 18. Both doors 36, 38 are biased by springs 37, 39 toward the closed position, overlying openings 44, 46 in the side walls 16, 18, respectively.

Figure 3:
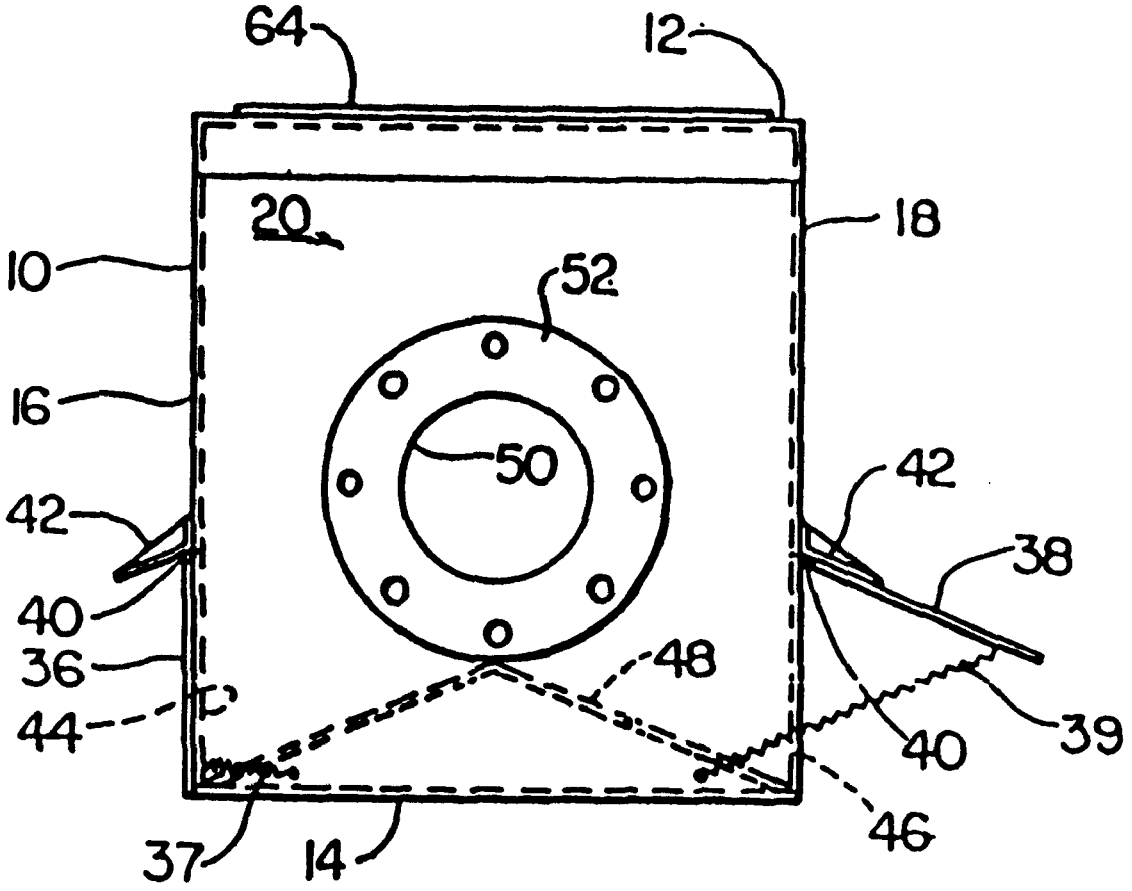
FIG. 3 is an aft end elevational view of the separator of FIG. 1.

The body portion 10 is provided with an internal floor 48 slanted toward the bottom wall 14 and toward the side wall openings 44, 46, as best seen in FIG. 3.

The body portion aft end wall 20 defines a separator outlet 50 around which is disposed a collar 52 adapted to be connected to a forward flange 54 of a pump inlet tube 56. The outlet 50 is hydrodynamically designed with a bell-shaped geometry to eliminate boundary flow separation and thus keep flow velocities and turbulence to a minimum. An aft end 58 of the pump inlet tube 56 is provided with an after flange 60 for connection to a pump inlet flange 62.

In operation, the separator is positioned below the surface of a water body and the pump and dredge head (not shown) are activated. Water, silt and bottom debris are taken in through the funnel portion entry end 26, past the one-way door 34, through the discharge end 30 of the funnel portion 24 and through the body portion forward inlet 32 into the body portion 10. As the funnel portion 24 enlarges forward-to-aft, the velocity of the fluid therethrough diminishes, without flow separation at the walls of the funnel 24. The fluid continues through the body portion 10, exits through the separator outlet 50 and enters the pump inlet tube 56 on its way to the pump, to be forwarded to a dump site (not shown), such as a holding basin.

When a relatively heavy object enters the funnel portion 24, the object slows and falls toward the floor 48. Upon reaching the floor 48 in the body portion 10, the object moves down the slanted floor 48 toward one of the openings 44, 46. Periodically, as, for example, every 500–1000 feet, the operator stops the pump, causing water pressure due to back flow and the closure of the door 34 to build press in the body portion 10. The increased pressure and the weight of the object against the door 36, 38 exceeds the spring bias and outside water pressure holding the door 36, 38 closed, causing the door to open and the heavy object to exit through the open door. The extent to which the doors 36, 38 open is limited by stop members 42, to prevent damage to the springs 37, 39 and to insure that the doors 36, 38 do not open flat against the walls 16, 18 where the springs 37, 39 would tend to hold the door open. Upon resumption of pump operations, the spring bias closes the door to again overlie its opening 44, 46. Suction from the pump keeps the doors 36, 38 closed.

Thus, separation of objects from the fluid stream occurs due to a hydrodynamically efficient reduction of the stream velocity, causing the heavy objects to drop out of the stream flow. No screens, grates, or other mechanical separators are required.

Preferably, the body portion 10 is provided with an access plate or hatch 64 on the top wall 12 thereof to facilitate cleaning of the body portion 10 and funnel portion 24, and to permit removal of large objects which become lodged in the body portion 10 and fail to exit.

It is to be understood that the present invention is by no means limited to the particular construction herein disclosed and/or shown in the drawings, but also comprises any modifications or equivalents within the scope of the claims.

Having thus described our invention, what we claim as new and desire to secure by Letters Patent of the United States is:

1. A debris separator for a dredge pump, said separator comprising:

a body portion having a top wall, a bottom wall, first and second side walls, and an aft end wall, said aft end wall defining a separator outlet for connection to the pump;

a funnel portion having an entry end defining a separator inlet and a larger discharge end fixed to a forward inlet end of said body portion;

a door hingedly mounted on said body portion first side wall and spring biased to a closed position overlying an opening in said first side wall; and a floor in said body portion slanted toward said bottom wall and toward said first side wall opening;

whereby upon stopping of the pump, an object in said body portion moves along said slanted floor to said door, is forced by water flow and pressure to open said door against said spring bias, and to exit said separator, and whereby upon starting of the pump, said door closes under said spring bias and suction pressure.

2. The separator in accordance with claim 1 wherein said funnel portion is provided with a one-way valve permitting flow only into said separator.

3. The separator in accordance with claim 2 wherein said one-way valve is closed by back flow through said funnel portion.

4. The separator in accordance with claim 1 further comprising a second door hingedly mounted on said body portion second side wall and spring biased to a closed position overlying a second opening in said second side wall, and a portion of said floor is slanted toward said second wall opening.

5. The separator in accordance with claim 1 wherein said floor extends into said funnel portion.

6. The separator in accordance with claim 1 wherein said funnel portion is provided with rearwardly diverging walls and wherein the angles of divergence of said walls prevent separation of water flow from said walls, thereby insuring maximum reduction of water flow velocity through said funnel portion without occurrence of turbulent eddies.

7. The separator in accordance with claim 1 wherein said outlet in said aft end wall is provided with a bell-shaped mouth to eliminate boundary flow separation at said outlet, thus minimizing flow velocity therethrough and turbulence.

* * * * *